United States Patent [19]

Deininger

[11] Patent Number: 4,831,688

[45] Date of Patent: May 23, 1989

[54] DOOR STOP

[76] Inventor: James M. Deininger, 6101A Joaquin Murieta Ave., Newark, Calif. 94560

[21] Appl. No.: 189,391

[22] Filed: May 2, 1988

[51] Int. Cl.[4] ..... E05D 11/10

[52] U.S. Cl. ..... 16/319; 16/374; 16/82; 16/DIG. 17; 16/DIG. 21; 292/288

[58] Field of Search ..... 16/82, 319, 374, DIG. 17, 16/DIG. 21, 343; 292/288, 342, 343

[56] References Cited

U.S. PATENT DOCUMENTS

| | | | |
|---|---|---|---|
| 79,950 | 7/1868 | Carkeet | 16/343 |
| 83,967 | 11/1868 | Horrell | 292/288 |
| 314,105 | 3/1885 | Carnes | 16/223 |
| 377,852 | 2/1888 | Giesy | 16/377 |
| 485,613 | 11/1892 | Deane | 16/353 |
| 609,277 | 8/1898 | Isidor | 16/374 |
| 1,060,641 | 5/1913 | Sladden | 16/349 |
| 1,344,538 | 6/1920 | Kaufman | 16/305 |
| 1,616,265 | 2/1927 | Kroehling | 292/288 |
| 2,003,856 | 6/1935 | Gimbel | 292/288 |
| 2,396,982 | 3/1945 | Bousquet | 292/289 |
| 2,488,688 | 11/1947 | Simmons | 16/353 |
| 2,532,586 | 12/1950 | Wickwire | 292/288 |
| 2,592,230 | 4/1952 | Allen | 16/223 |
| 3,157,906 | 11/1961 | Wolf | 16/50 |
| 3,420,399 | 1/1969 | Heisler | 220/324 |
| 3,773,369 | 11/1973 | Wersonick | 292/150 |
| 4,268,074 | 5/1981 | Alexander | 292/149 |
| 4,738,002 | 4/1988 | Shank | 16/82 |

FOREIGN PATENT DOCUMENTS

| | | | |
|---|---|---|---|
| 2594880 | 8/1987 | France | 16/319 |

*Primary Examiner*—Nicholas P. Godici
*Assistant Examiner*—Edward A. Brown

[57] ABSTRACT

A mechanism which prevents a door from closing by blocking the door hinge from closing.

5 Claims, 1 Drawing Sheet

DOOR STOP

BACKGROUND

1. Field of Invention

This invention relates to mechanisms which hold a hinge in a rigid position in order to keep a door or window in an open position.

BACKGROUND—CROSS-REFERENCE TO RELATED APPLICATIONS

A patent application was submitted to the Commissioner of Patents on Apr. 26, 1988 for a "Door Lock-/Door Stop" invention which I developed. This invention combines the features of a door lock and door stop in a single device.

2. Description of Prior Art

Heretofore, door stops consists of wedges placed under the door or objects placed in the path of the door to prevent the door from closing. On doors which had mechanisms to close automatically, the wedges would often slide if the floor surface was smooth, thereby failing to stop the door from closing. The wedges also required people to bend over to place the wedge under the door. Sometimes people would lean against the door, thereby loosening the wedge. This would then cause the door to close when they stopped leaning on the door, even though they had not intended this to occur.

The Lock Hinge patent, U.S. Pat. No. 83,967, does prevent a window from closing by using a structure to hold the window rigid against the window frame. However this structure only allows windows to be kept in a fully open position and does not allow windows or other structures to be opened to specific angles.

OBJECTS AND ADVANTAGES

Accordingly I claim the following as my objects and advantages of the invention: that this invention prevents a door from closing without having to bend down to place a wedge or object against a door, that it is portable and can be used as a door stop by travelers and by janitors or maids in hotels, and that it has no moving parts.

Readers will find further objects and advantages of the invention from a consideration of the ensuing description and the accompanying drawings.

DRAWING FIGURES

DRAWING REFERENCE NUMERALS

10, door hinge

12, structure

24, "J" support

26, base

DOOR STOP—DESCRIPTION

Figure 1:
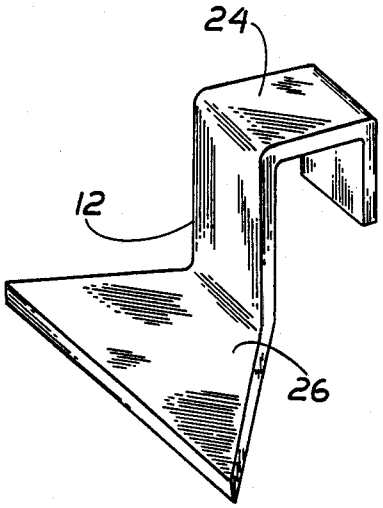
FIG. 1 is a perspective view of my invention.
Figure 2:
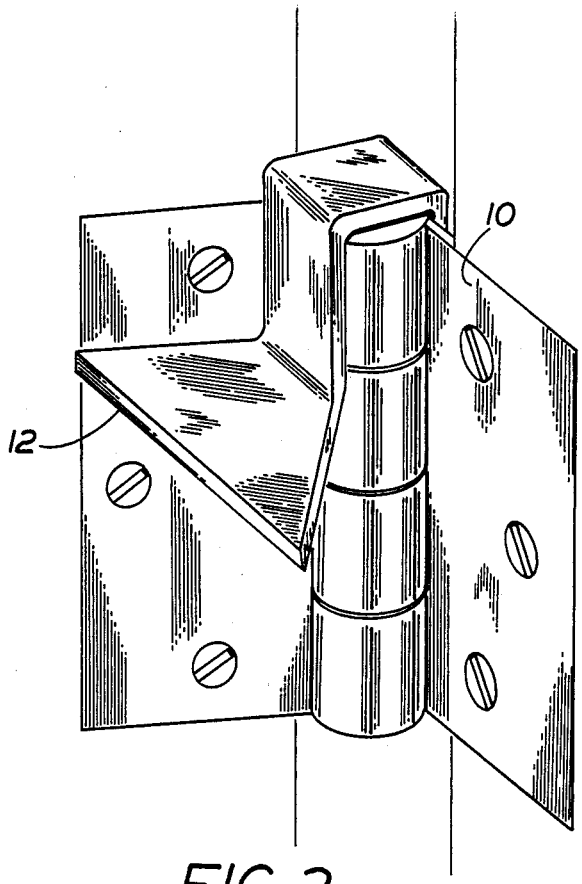
FIG. 2 is a perspective view of my invention in use on a door hinge.

FIG. 1 shows the Door Stop according to the preferred embodiment of the invention. This stop comprises a quadrilateral base with an inverted "J" shaped support 24 attached. The support hooks over the door hinge and prevents the base from moving. The base 26 prevents the door hinge from closing. The base is shaped to hold a door open at a right angle to the door frame. The shape of the base may be altered in order to hold the door at different angles.

DOOR STOP—OPERATION

The preferred embodiment of the invention as shown in FIG. 1 can act as a door stop by placing the inverted "J" shaped support over the door hinge. The base then prevents the hinge from closing.

The Door Stop uses the properties of the door hinge to prevent the door from being closed by pinning the door in the open position.

The Door Stop can be used by maids in hotels, business travelers, homeowners, apartment dwellers and anyone who needs to prevent a door from being closing.

CONCLUSION, RAMIFICATIONS AND SCOPE OF INVENTION

While my above description contains many specificities, these should not be construed as limitations on the scope of the invention but rather as an exemplification of the preferred embodiments thereof. Many other variations are possible. Accordingly, the scope of the invention should be determined not by the embodiments illustrated, but by the appended claims and their legal equivalents.

I claim:

1. A doorstop mechanism consisting of:

(a) a strut to constrain a door hinge from closing more than a designated amount;

(b) a inverted "J" or "U" shaped support to hold said strut in place between the door hinge plates;

(c) said support being joined to the strut at one end of the inverted "J" or "U" shaped support to support said strut between the door hinge plates.

2. The strut and support of claim 1 wherein said strut and support are composed of metal, wood or plastic.

3. The strut of claim 1 wherein said strut is shaped in the form of a quadrilateral.

4. The quadrilateral strut of claim 3 wherein said strut lies perpendicular to the door hinge.

5. The strut of claim 1 wherein said strut is shaped to hold a door open with a ninety or 180 degree angle between the door hinge plates.

* * * * *